United States Patent [19]

Powell

[11] Patent Number: 4,618,119

[45] Date of Patent: Oct. 21, 1986

[54] ADJUSTABLE INCLINATION READING/WRITING BOARD

[76] Inventor: Roger A. Powell, 1589 Vernon Rd., Norristown, Pa. 19401

[21] Appl. No.: 652,292

[22] Filed: Sep. 19, 1984

[51] Int. Cl.[4] ..... A47G 1/24; A47B 97/08

[52] U.S. Cl. ..... 248/456; 248/465

[58] Field of Search ..... 248/456, 463, 465, 447

[56] References Cited

U.S. PATENT DOCUMENTS 1,564,594 12/1925 Leh ..... 248/465 X
1,580,344 4/1926 Stillians ..... 248/456
3,376,009 4/1968 Domino ..... 248/456

FOREIGN PATENT DOCUMENTS 535329 9/1931 Fed. Rep. of Germany ..... 248/456
795707 5/1958 United Kingdom ..... 248/463

*Primary Examiner*—Ramon S. Britts
*Assistant Examiner*—Karen J. Chotkowski

[57] ABSTRACT

An adjustable inclination reading/writing board for attachment to a table or desk top. A single operating lever disengages a support member from base strip members on the table top, allowing the inclination of the planar board member to be adjusted.

3 Claims, 4 Drawing Figures

ADJUSTABLE INCLINATION READING/WRITING BOARD

BACKGROUND OF THE INVENTION

Historically, it has been desirable to read and write on an inclined surface rather than the horizontal surface of a table or desk. Human factor studies have established the benefits of less fatigue and greater efficiency. Prior to the present invention, the apparatus available have been cumbersome, complex and expensive. For example, the invention disclosed in U.S. Pat. No. 1,401,458 to Boon incorporates sliding strips to grip the table top, a movable pivot location for the inclination feature, a separate writing surface support structure, a rotable writing surface in its own plane, and individual inclination support elements which must be separately manipulated by the user. The number of adjustments available and the ensuing complexity inhibits the economic usefulness of the device. Also, the writing surface does not collapse to a horizontal work surface.

OBJECTS OF THE INVENTION

One object of this invention is to provide a simple inclined reading/writing board to be positioned on a table or desk. Another object is to provide a reading/-writing board that is easily adjustable in inclination by manipulating one control lever. Another object is to provide a reading/writing board that can be adjusted to lie flat on a table or desk top. Another object is to provide a reading/writing board with a minimum of simple parts which will lead to low manufacturing costs.

SUMMARY OF THE INVENTION

The present invention is composed of a planar reading/writing board element pivotally attached at its rear face near its lowest or bottom edge to base strips which rest on the table top. A wire support in the shape of an inverted letter "U" is pivotally attached to the rear face of the reading/writing board near its vertical midpoint and ears on the wire support/selectively engage notches in the top surface of the base strips to change the inclination. An extended ear on the wire support engages an unlatching bar. Operating the unlatching bar allows the reading/writing board to be adjusted to a lower position or to a horizontal position, if desired. The horizontal position capability is important since some tasks require it, and it is not desirable to remove the present invention from the table top. The use of the unlatching bar or simply moving one of the ears directly allows adjustment by manipulating one control surface since the ears are directly coupled and disengage simultaneously.

DETAILED DESCRIPTION OF THE PREFERRED EMBODIMENT

Figure 1:
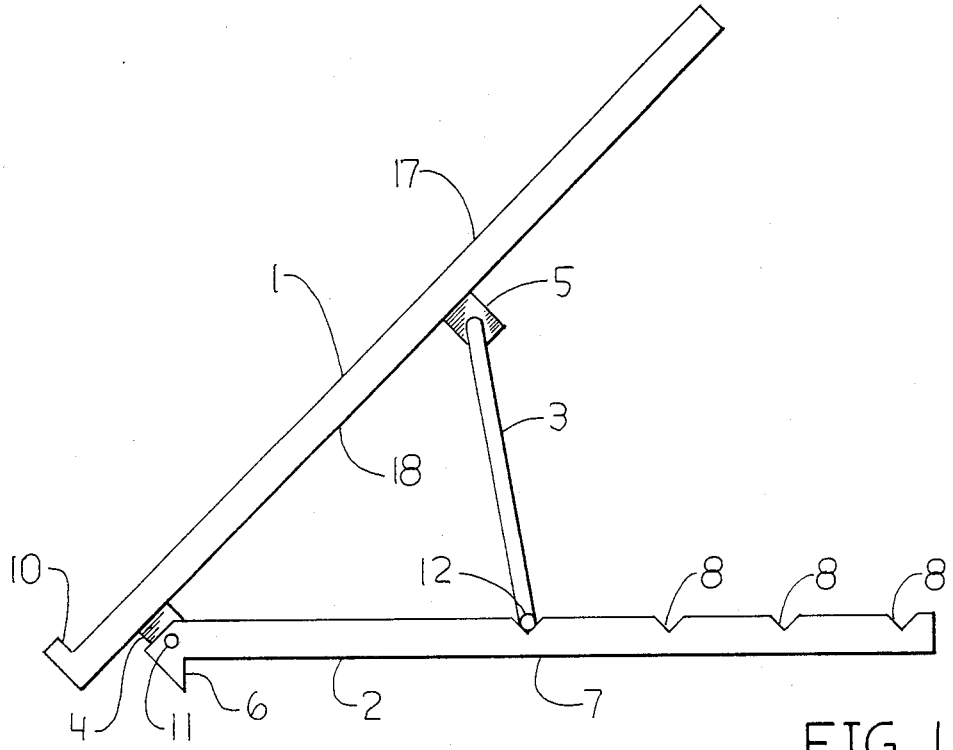
FIG. 1 shows a side elevation of the adjustable inclination reading/writing board at inclination of 45 degrees.

FIG. 1 shows the reading/writing board member 1 with a protruding lip 10 extending from the front face

Figure 3:
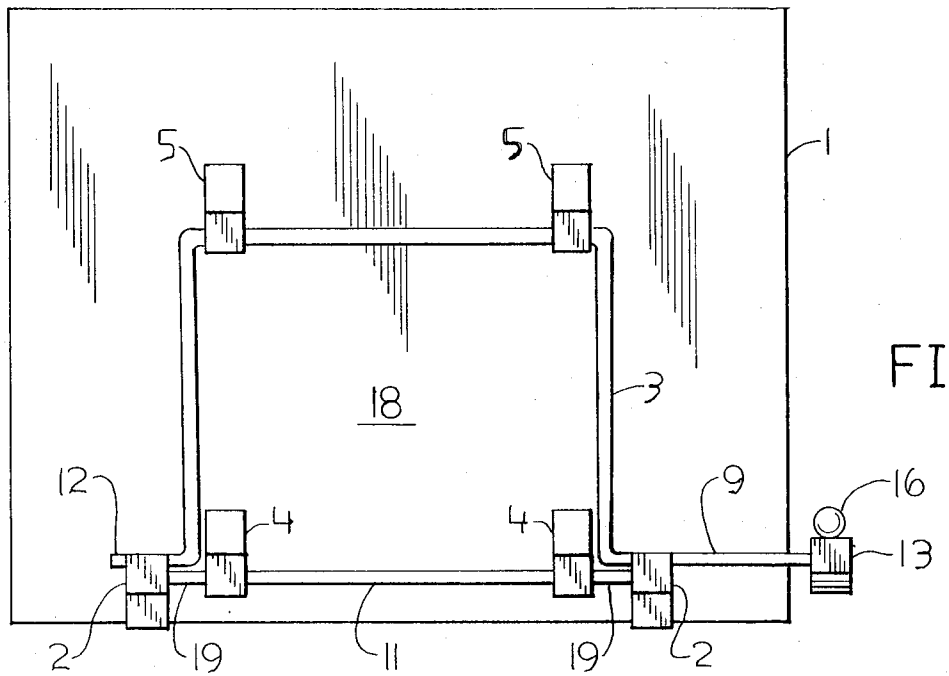
FIG. 3 shows a rear elevation of the invention at a 45 degree inclination.
Figure 4:
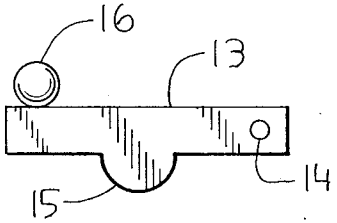
FIG. 4 shows the disengagement control arm.

17 along the bottom edge nearest the user. A pair of brackets 4 are attached to the rear face 18 of the reading/writing board member. A pivot rod 11 passes through cylindrical holes in the brackets 4 and through holes in the base strips 2, thus pivotally coupling the reading/writing board element to the base strips. Further, the base strips are directly and rigidly attached to the pivot rod 11, thereby establishing the spacing between the base strips and that they lie in the same plane. Tubular spacers, 19 are used between the brackets 4 and the base strips 2 on pivot rod 11 to limit motion between the reading/writing board element and the base strips and pivot rod assembly in the direction of the axis of the pivot rod 11. The base strips have a lip 6 protruding downward that contacts the edge of the table nearest the user. The bottom surface 7 of the base strips 2 contact the top surface of the table. The top surface of the base strips 2 have a series of transverse notches 8. At approximately one-half of the height of the reading/-writing board member 1 on its rear face 18 are located another set of brackets 5. These brackets 5 pivotally attach the inverted letter "U" shaped prop element 3 to the reading/writing board member 1. As can be seen in FIG. 3, the prop element 3 is formed of wire rod such that it can selectively engage the notches 8 in the base strips 2 with the extensions 12 and 9. The prop element has an extended side 9 which also engages a hole 14 in the adjustment member 13. The notches 8 in the base strips 2 are configured to allow the extensions 12 and 9 of the prop element 3 to escape when moved in the direction toward the lip 6 thus creating ratchetting action when increasing the inclination; and to hold the extensions 12 and 9 in the opposite direction, thus supporting the forces against the reading/writing board 1. The adjustment member 13 releases the extensions 9 and 12 from the notches in the decreasing inclination direction. This is accomplished by the user pressing down on knob 16 which causes the adjustment member 13 to pivot about the fulcrum 15 that is resting on the table surface, thus raising hole 14 and the prop element extension 9 which also simultaneously raises extension 12. The extension 9 can also be raised directly by the user without the benefit of the adjustment element 13, but the user is required to reach further to accomplish the adjustment, which is a marked disadvantage.

Figure 2:
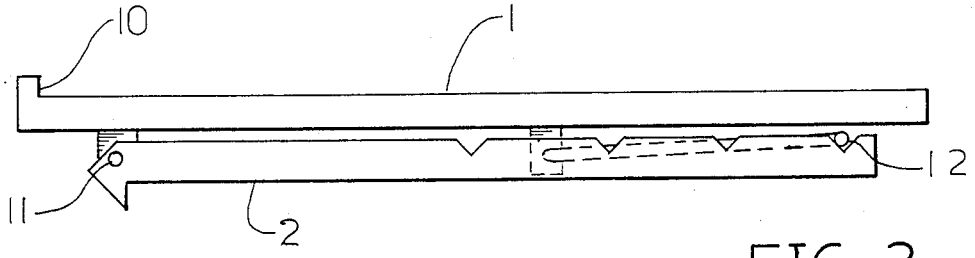
FIG. 2 shows a side elevation of the invention in the zero inclination or horizontal position.

As can be seen in FIG. 2 and FIG. 3, the legs of prop element 3 will rest between the brackets 4 and brackets 5 and the base strips 2 when the reading/writing board 1 is folded to the horizontal position.

I claim:

1. A writing board of adjustable inclination to be used on a table top, comprising:

a. a planar member having: a front face; a bottom edge, perpendicular to said front face; a rear face, opposed to said front face; a first pivotal attachment means on said rear face, adjacent to said bottom edge, having an axis parallel to said bottom edge; a second pivotal attachment means on said rear face, having an axis parallel to said first pivotal attachment;

b. a plurality of base strip members having: a third pivotal attachment means at one end, coupled to said first pivotal attachment means on said planar member; a bottom face that contacts said table top, having a lip protruding downward, in proximity to said third pivotal attachment means, said lip contacting a vertical face of said table top; a top face, opposed to said bottom face, having multiple spaced engagement means;

c. a prop member coupled to said second pivotal attachment means on said planar member having means for engagement with said multiple spaced engagement means on said base strip members;

d. disengaging means for simultaneously disengaging all said engagement means between said prop member and said base strip members, whereby the inclination of said planar member may be changed; said disengaging means comprising an elongated member attached to said prop member at one end thereof opposite said second pivotal attachment means, an adjustment member having first and second ends and being mounted at said first end to a free end of said elongated member, said adjustment member having a fulcrum disposed thereon between said first and second ends for contacting said table top and having a manual operating surface at said second end.

2. A writing board as recited in claim 1 wherein said planar member, said base strip members, said prop member and said pivotal attachment means are spatially arranged to allow said planar member to be adjusted to a horizontal position.

3. A writing board as recited in claim 1, wherein said prop member is a bent wire.

* * * * *